US005797466A

United States Patent [19]

Gendle

[11] Patent Number: 5,797,466

[45] Date of Patent: Aug. 25, 1998

[54] POWERED IN-LINE SKATE

[76] Inventor: Timothy A. Gendle, 29560 Lone Tree Rd., Oakdale, Calif. 95361

[21] Appl. No.: 811,678

[22] Filed: Mar. 5, 1997

[51] Int. Cl.[6] ..... A63C 17/12

[52] U.S. Cl. ..... 180/181; 74/664; 180/65.6

[58] Field of Search ..... 180/180, 181, 180/214, 220, 65.1, 65.5, 65.6; 74/664, 413; 280/249, 250, 260

[56] References Cited

U.S. PATENT DOCUMENTS

| | | | |
|---|---|---|---|
| 823,385 | 6/1906 | Beauford | 180/181 |
| 1,672,700 | 6/1928 | Vass | 180/181 X |
| 2,857,008 | 10/1958 | Pirrello | 180/181 |
| 3,754,612 | 8/1973 | Watanabe et al. | 180/219 |
| 4,094,372 | 6/1978 | Notter | 180/181 |
| 4,508,187 | 4/1985 | Wenzel | 180/181 |
| 5,020,621 | 6/1991 | Martin | 180/181 |
| 5,127,488 | 7/1992 | Shanahan | 180/181 |
| 5,236,058 | 8/1993 | Yamet et al. | 180/181 |

FOREIGN PATENT DOCUMENTS

| | | | |
|---|---|---|---|
| 1358370 | 3/1964 | France | 180/181 |
| 23087 | 2/1994 | Japan | 180/181 |
| 1026277 | 4/1966 | United Kingdom | 180/181 |

*Primary Examiner*—J. J. Swann
*Assistant Examiner*—Michael Mar
*Attorney, Agent, or Firm*—L. E. Carnahan

[57] ABSTRACT

A powered skate having a small motor mounted on an in-line rollerblade with a hand-held throttle. The motor, such as a small internal combustion engine, is mounted at the rear of an in-line skate having a frame secured to a user's shoe or boot and drives the rear roller via a reduction gear train, which may include a clutch assembly. The engine is started by a pull cord, and the engine speed is controlled by a hand-held control unit attached to the engine via a throttle cable, which may be secured to the user's body via arm and leg straps. The powered in-line skate and a non-powered in-line skate can safely drive a user to speeds of about 20 MPH, this providing alternate transportation for the user.

18 Claims, 6 Drawing Sheets

POWERED IN-LINE SKATE

BACKGROUND OF THE INVENTION

The present invention relates to a in-line skate, particularly to a powered in-line skate, and more particularly to an in-line skate driven by an internal combustion engine mounted on the in-line skate and controlled by a hand-held unit.

Various types of alternate transportation modes for an individual have been developed to reduce the consumption of fuel and the costs associated with standard vehicle transportation. These alternate transportation modes include various human driven arrangements including bicycles, skate boards, roller skates, in-line skates, etc., which provide exercise in addition to transportation. To increase the range and speed of travel, recent efforts have been directed to motorize these alternate modes of individual transportation. These prior efforts are exemplified by U.S. Pat. No. 3,754,812 issued Aug. 28, 1973 to Y. Watanabe et al; U.S. Pat. No. 4,508,187 issued Apr. 2, 1985 to W. B. Wenzel; U.S. Pat. No. 5,020,621 issued Jun. 4, 1991 to C. V. Martin; and U.S. Pat. No. 5,236,058 issued Aug. 17, 1993 to I Yamet et al.

The present invention involves another approach to alternate transportation for either pleasure or work, and enables the user to travel safely at speeds of up to 20 MPH and above, thus enabling an extended range of travel in a shorter time period without being physically exhausted when the longer destination point is reached. The invention involves powered or motorized in-line skates, wherein only one in-line skate of a pair is motorized. A small internal combustion engine is mounted on the in-line skate via a reduction gear train, and is located at the back of a user's boot secured to the in-line skate frame, and connected to drive the rear wheel of the in-line skate. The engine is speed controlled by a hand-held control unit. A centrifugal clutch arrangement may be incorporated into the reduction gear train.

SUMMARY OF THE INVENTION

It is an object of the present invention to provide a powered in-line skate.

A further object of the invention is to provide a motorized in-line skate.

A further object of the invention is to provide a powered in-line skate driven by an engine through a centrifugal clutch.

Another object of the invention is to provide a pair of in-line skates with one being driven by an internal combustion engine.

Another object of the invention is to provide a in-line skate driven through a reduction gear train by a motor mounted on the in-line skate.

Another object of the invention is to provide a pair of in-line boot mounted skates, with one of the skates driven by an engine mounted at the rear of the boot via a belt and gear arrangement, with a hand-held engine speed control unit.

Other objects and advantages of the present invention will become apparent from the following description and accompanying drawings. Basically the invention involves a powered and non-powered pair of rollerblades, with the powered in-line skates having a hand-held speed control arrangement. In the illustrated embodiment, the powered in-line skate is of a boot-mounted type with a small (0.8 to 1.0 horsepower) internal combustion engine mounted at the rear of the boot and connected to a rear wheel of the in-line skate via a reduction gear train, with the speed of the engine being controlled by a hand-held control unit which includes a throttle cable connected to the carburetor of the engine. For safety purposes, the throttle cable may be retained by straps around the user's arm and leg. The reduction gear train may include a belt and gear arrangement, or may include a centrifugal clutch arrangement. The gear ratio from the engine shaft to the drive wheel of the in-line skate is in the range of 5:1 to 6:1, whereby with an engine of 21 cc to 24 cc or 0.8 to 1.0 horsepower operating at an RPM of idle to 10,000, it can safely drive a user (weight of 100–250 lbs.) at a speed of up to 20 MPH, depending on the weight of the user and the surface on which the user is traveling. With a 0.8 to 1.0 horsepower engine, fuel consumption is in the range of 80 to 110 miles per gallon. With a reduction track gear ratio of 5 to 1, there is less torque than a gear ratio of 6 to 1, but the speed will increase by about 3 miles per hour.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

The present invention is directed to a powered in-line skate which is controlled by a hand-held unit. A small internal combustion engine is mounted behind a boot of the in-line skate and connected to a wheel thereof via a reduction gear train. The engine is started by a pull cord and the speed is controlled through a throttle cable connected to a lever of the hand-held control unit. For safety purposes, the throttle cable may be retained by straps secured to a user's leg and/or arm. In the illustrated embodiment, the engine is mounted at the rear of one of a pair of boots or shoe-type in-line skates via an extension of the frame of the rollerblade and connected to drive the rear wheel thereof. The engine is not secured to the boot or shoe. As known, in-line skates are available with the shoe or boot and are constructed to be clamped onto a user's shoe, and thus the engine is mounted free of the shoe. The embodiment illustrated involves an in-line skate having in-line wheels. However, the invention can be incorporated on non-in-line wheel skates. The reduction gear train of the illustrated embodiment utilizes a belt drive between the engine shaft and a first gear of the train, which utilizes three reduction gears with the largest gear secured to the rear wheel of the in-line skate, although the gear train could be constructed to drive another wheel of the in-line skate. Also, a. centrifugal clutch arrangement may be incorporated into the gear train.

Figure 1:
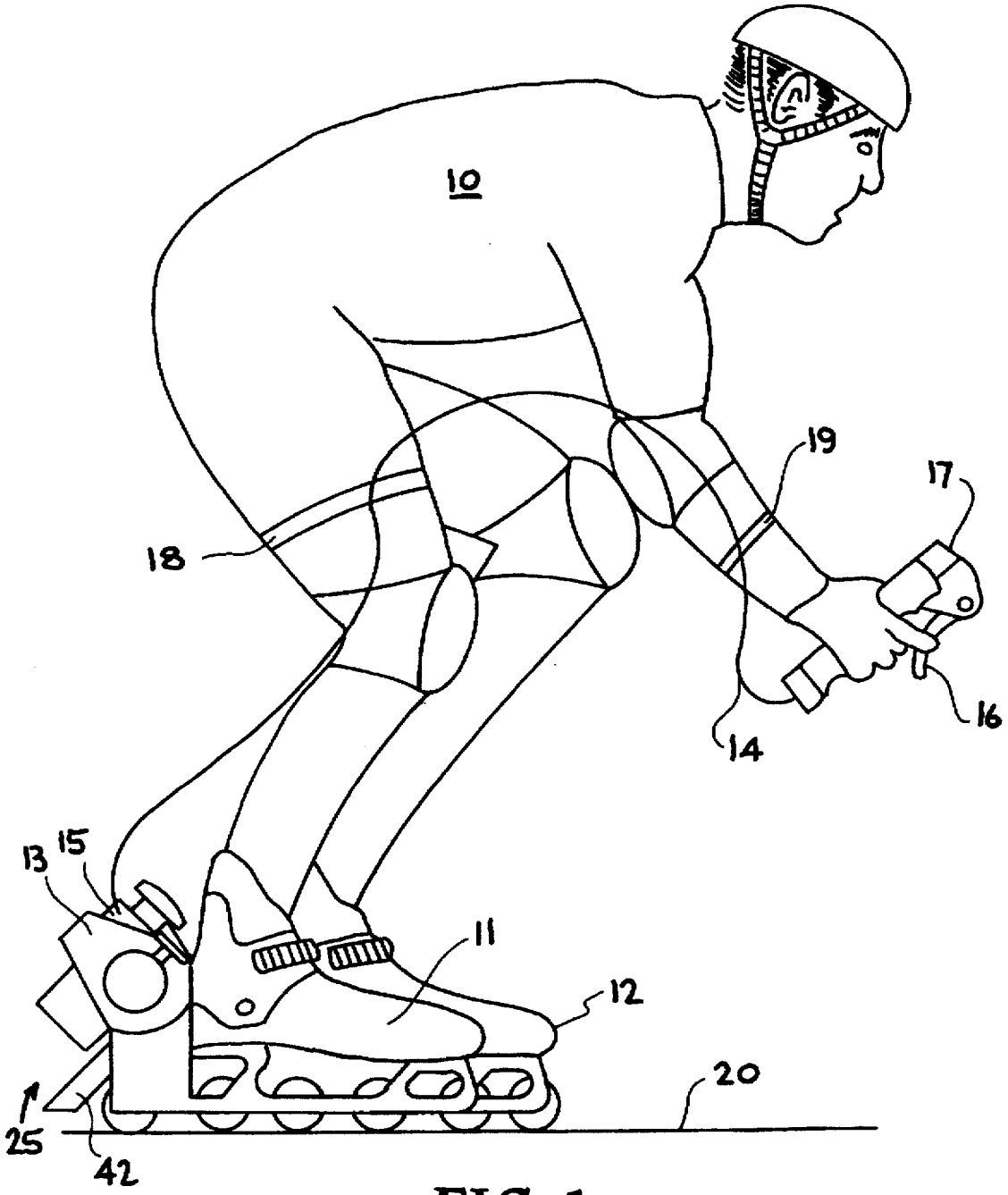
FIG. 1 schematically illustrates the present invention using a boot-mounted powered in-line skate and a hand-held control unit.

Referring now to the drawings, FIG. 1 schematically illustrates a user 10 for a pair of in-line skates, one in-line skate 11 being a powered unit and the other in-line skate 12 being a non-powered unit with a motor, such as an internal combustion engine 13 mounted at the rear of the powered unit 11, the speed of the engine 13 being controlled through a throttle cable 14 connected at one end to a throttle 15 of the engine carburetor and at the other end to a spring-biased, finger actuated throttle lever 16 of a hand-held control unit 17. The throttle cable 14 is retained by a leg strap or band 18 and an arm strap or band 19 for safety purposes. The throttle cable 14 is conventional in that it has an outer member in which is movably mounted a wire or rod that is moved by the lever 16. The user 10 may be safely propelled along a surface 20 at speeds up to and above 20 MPH by the mere use of the finger actuated throttle lever.

Figure 2:
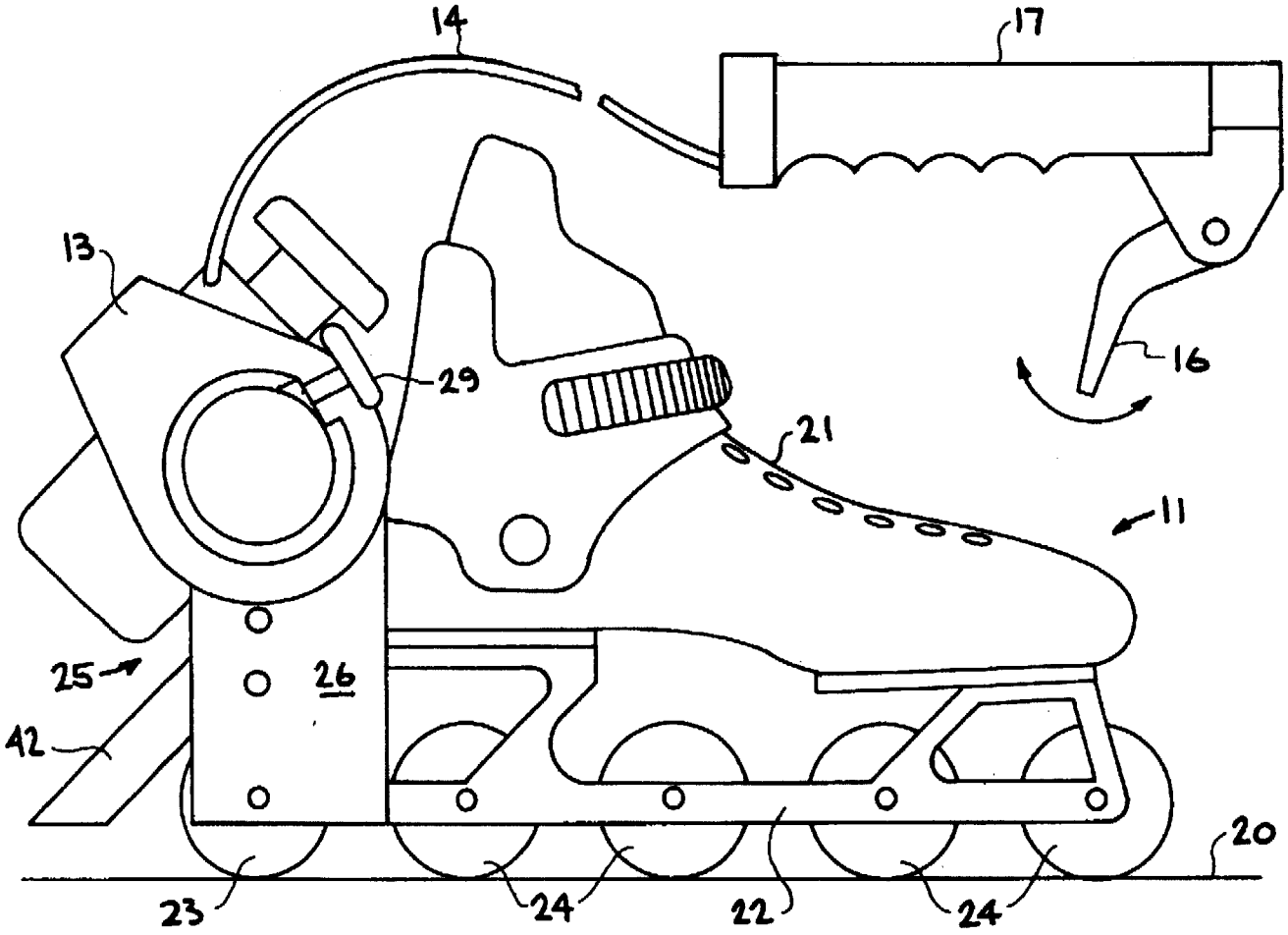
FIG. 2 illustrates one side of the powered in-line skate and attached control unit.
Figure 3:
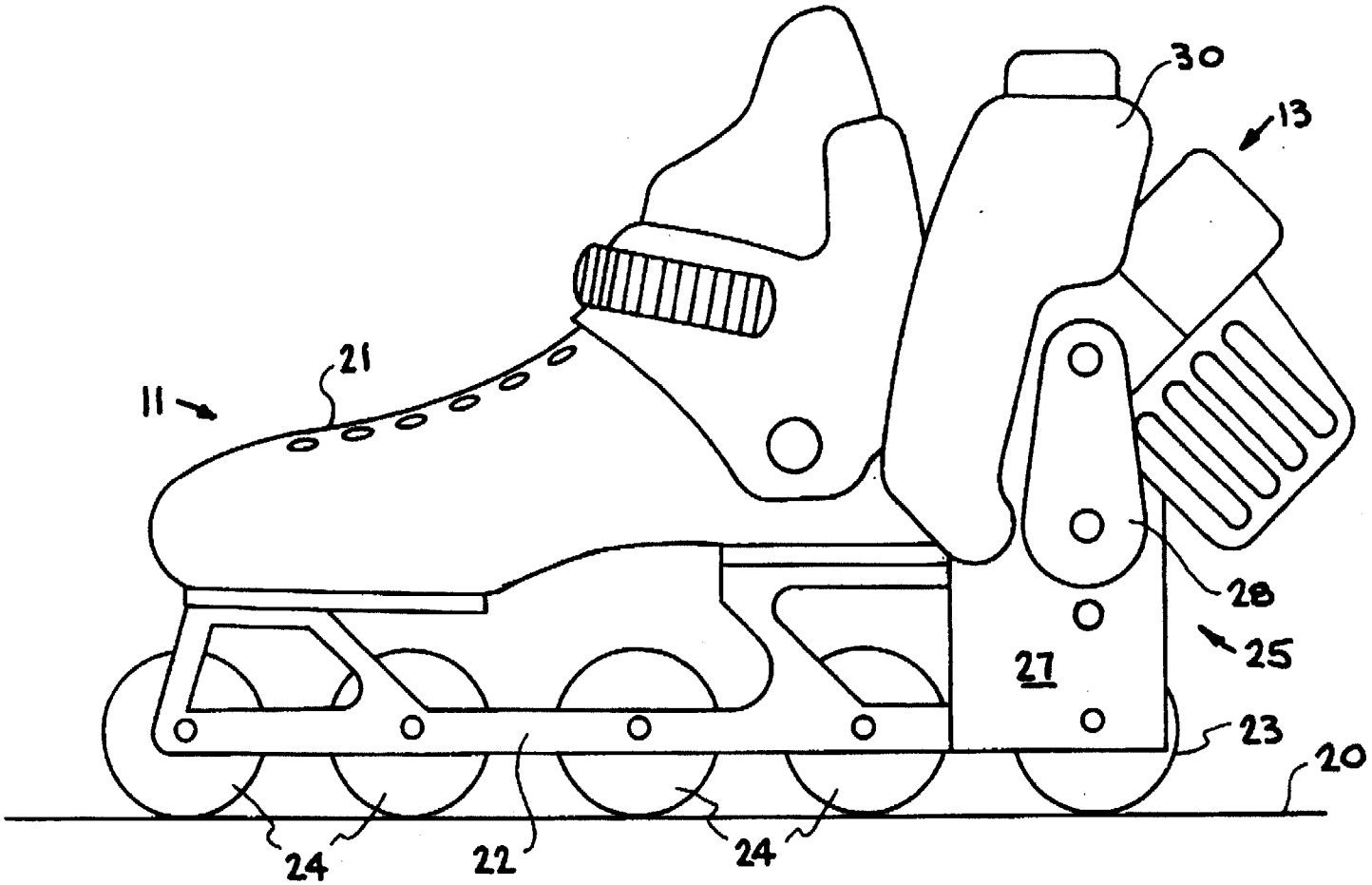
FIG. 3 illustrates an opposite side of the powered in-line skate without the control unit.

As shown in FIGS. 2 and 3, the powered in-line skate unit 11 includes a boot 21 secured to a frame 22 to which is mounted a plurality of in-line wheels, five (5) in this embodiment, with one wheel 23 being a powered or driven wheel and four wheels 24 being free or non-powered wheels. The engine 13 is mounted on frame 22 behind boot 21 and connected to powered wheel 23 via a reduction gear train generally indicated at 25, illustrated in detail in FIG. 4, and which includes mounting/cover plates or brackets 26–27 mounted on opposite sides of powered wheel 23, and a belt drive cover 28. As seen in FIGS. 2 and 3, engine 13 is provided with a pull started 29 and a fuel tank 30. The engine 13 may operate on gasoline or natural gas, but in this embodiment the engine 13 is a 21–24 cc or 0.8–1.0 horsepower gasoline engine manufactured by Echo, Inc., with the fuel tank 27 containing ⅛ gallon of unleaded fuel, sufficient to operate the engine at about an 80–110 mile per gallon (MPG) rate at about 20 miles per hour (MPH), wherein the engine output shaft 31 (see FIG. 4) is driven at about 10,000 revolutions per minute (RPM). When the engine 13 is started by pull starter 29, the engine will operate at a low (about 400) RPM. At that low or idle speed, the weight of the user 10 prevents driving of the powered wheel 23 via slippage of a drive belt (see FIG. 4) or via a variable speed clutch (see FIG. 6). For safety purposes, the reduction gear train 25 is designed such that the user 10 should initiate movement of the powered unit 11 prior to increasing the engine speed of the engine 13, whereafter the speed of engine 13 is controlled by movement of spring-biased, finger actuated throttle lever 16 as indicated by arrow 32.

Figure 4:
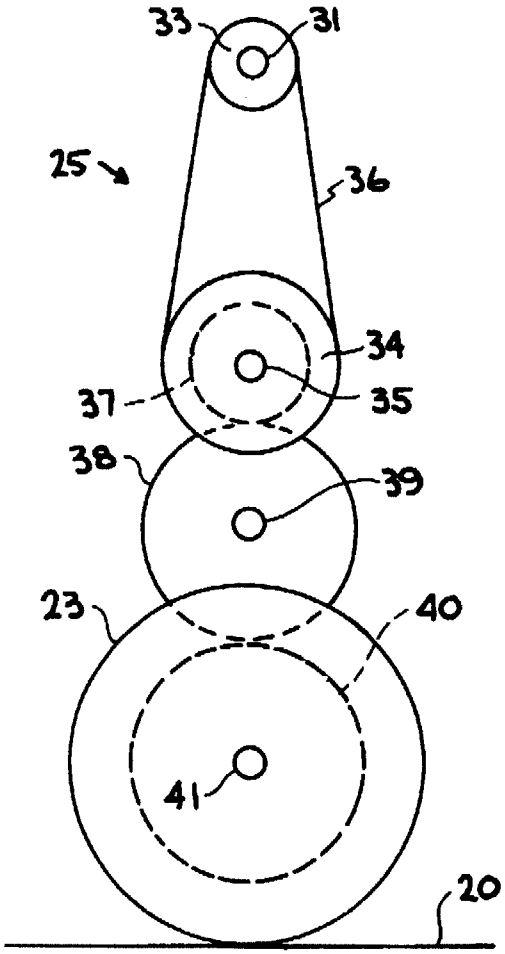
FIG. 4 schematically illustrates an embodiment of a reduction gear train for the powered in-line skate without a clutch.

FIG. 4 schematically illustrates an embodiment of reduction gear train 25 between powered or drive wheel 23 and output shaft 31 of engine 13, using a belt drive arrangement. As shown, this embodiment comprises a first pulley 33 secured to engine shaft 31, a second pulley 34 mounted on a first intermediate shaft 35, around which a booth drive belt 36 is driven by engine shaft 31. A first reduction or spur gear 37 is secured to first intermediate shaft 35 and drives a second reduction or spur gear 38 mounted on a second intermediate shaft 39 and which drives a final reduction or spur gear 40 which is secured to powered wheel 23 and to wheel axle or shaft 41. As seen in FIGS. 2 and 3, the second intermediate shaft 39 and the wheel axle 41 are supported in plates 26 and 27, with engine shaft 31 being supported in belt drive cover 28, and with first intermediate shaft 35 being supported in belt drive cover 28 and plate 26. While the ends of shafts 31, 35 and 39, and the ends of axle 41, are shown exposed for illustration purposes, the shafts and axle need not extend through plates or brackets 26–27 and cover 28. As seen in FIGS. 1 and 2, a rubber brake pad 42 is attached to the plates 26–27 so that braking action can be carried out by raising the toe of boot 21 causing the pad 42 to drag on the surface. Also, deceleration of the engine 13 will produce a braking effect.

Figure 5:
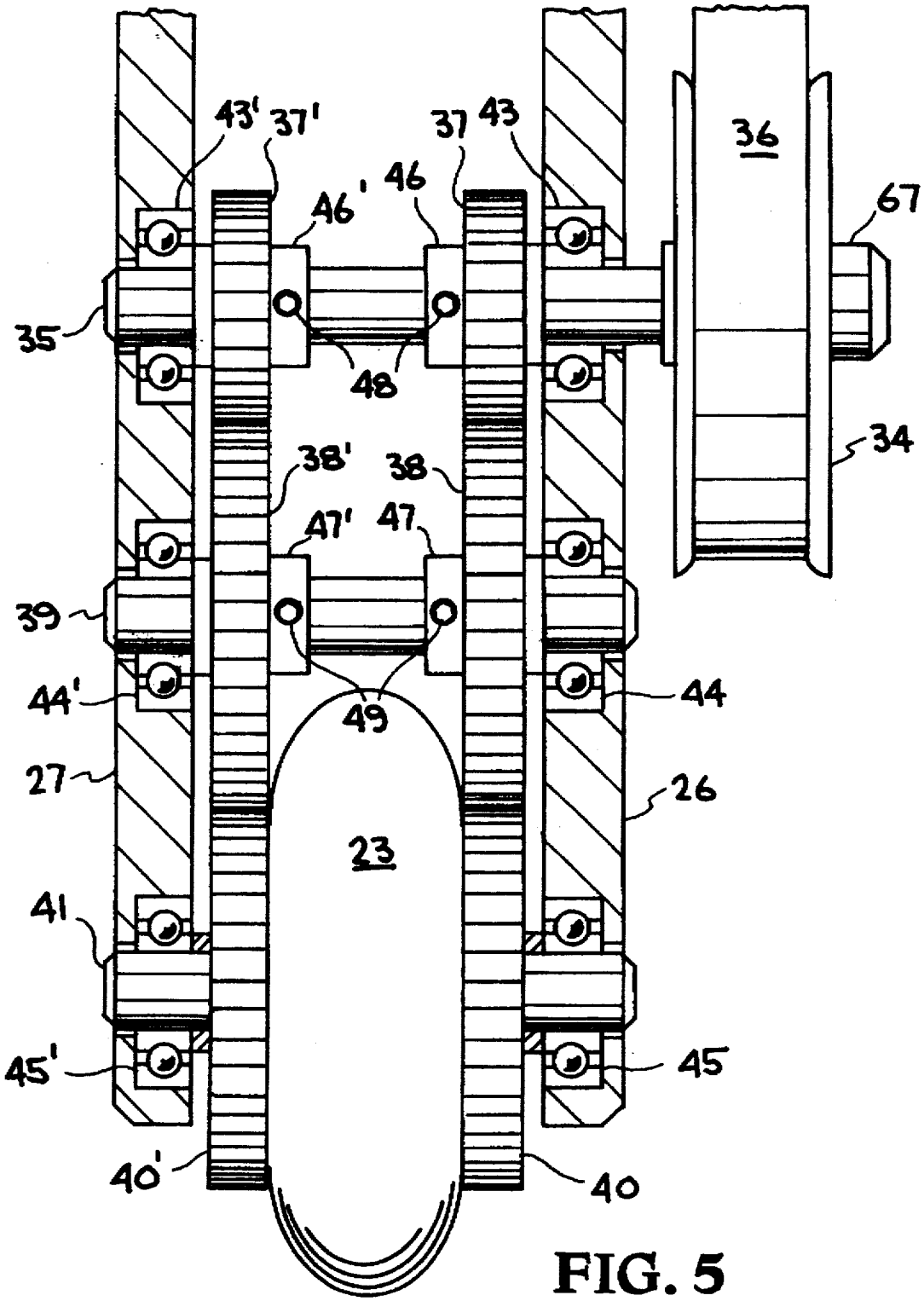
FIG. 5 illustrates an enlarged rear view of the powered in-line skate showing the reduction gear train.

For heavier duty uses, such as needed to carry a large user 10, or on a non-smooth surface 20, a. double set of reduction or spur gears 37, 38 and 41 may be utilized with each set being mounted as shown in FIG. 4 but secured on opposite sides of powered wheel 23, as illustrated in FIG. 5. By way of example, the first reduction gear 37 be a 24 pitch, 15 tooth gear with a width of 0.187 inch, and pitch diameter of 0.625 inch, with the second reduction gear 39 being a 24 pitch, 45 tooth gear width of 0.187 inches, pitch diameter of 1.875 inches; and with the final reduction gear 40 being a 24 pitch, 45 tooth gear having a width of 0.187 inch, and pitch diameter of 1.875 inches. The teeth on the outer periphery of gears 37, 39 and 40 may be cut at an angle or cut straight across the gear body. The engine drive shaft 31 may, for example, have a diameter of 0.500 inch, with shafts 35 and 39, and axle 41 each having a, diameter of 0.375 inch. The first pulley 33 may have a belt width clearance of 0.375 inch, an outer diameter of 0.625 inch, while second pulley 34 has a belt clearance width of 0.375 inch, an outer diameter of 1.25 inch, with toothed drive belt 36 having a length of 8 inches and width of 0.375 inch with 5 teeth per inch, with the distance between engine driven shaft 31 and the first intermediate shaft 34 being 2.485 inches. The pulley's gears and shafts are preferably constructed of metal and/or plastic, such as stainless steel and nylon, but may be constructed of a, different strong plastic or metal.

FIG. 5 illustrates a rear view of the reduction gear train 25 mounted on in-line skate frame 22. As seen, this embodiment of the gear train 25 comprises two reduction gears 37 and 37' mounted on shaft 35, two reduction gears 38 and 38' mounted on shaft 39, and two reduction gears 40 and 40' mounted on wheel axle 41 and connected to powered wheel 23. Shafts 35, 39, and 41 are mounted in cover plates 26 and 27 via bearing assemblies 43–43', 44–44', and 45–45', with shaft 35 being connected to the second pulley 34 driven by toothed drive belt 36 as shown in FIG. 4. The reduction gears 37–37' and 38–38' are secured on respective shafts 35 and 39 via collars 46–46' and 47–47' via bolts, screws or pins 48 and 49.

Figure 7:
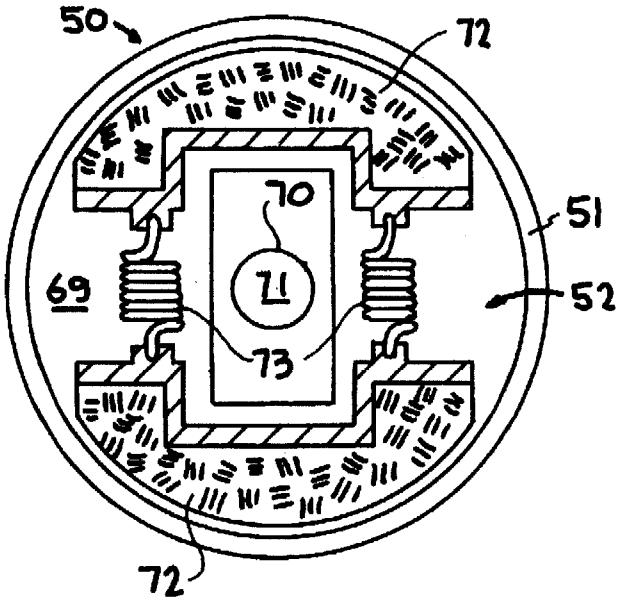
FIG. 7 is a partial cross-sectional enlarged view of the clutch of FIG. 6.
Figure 6:
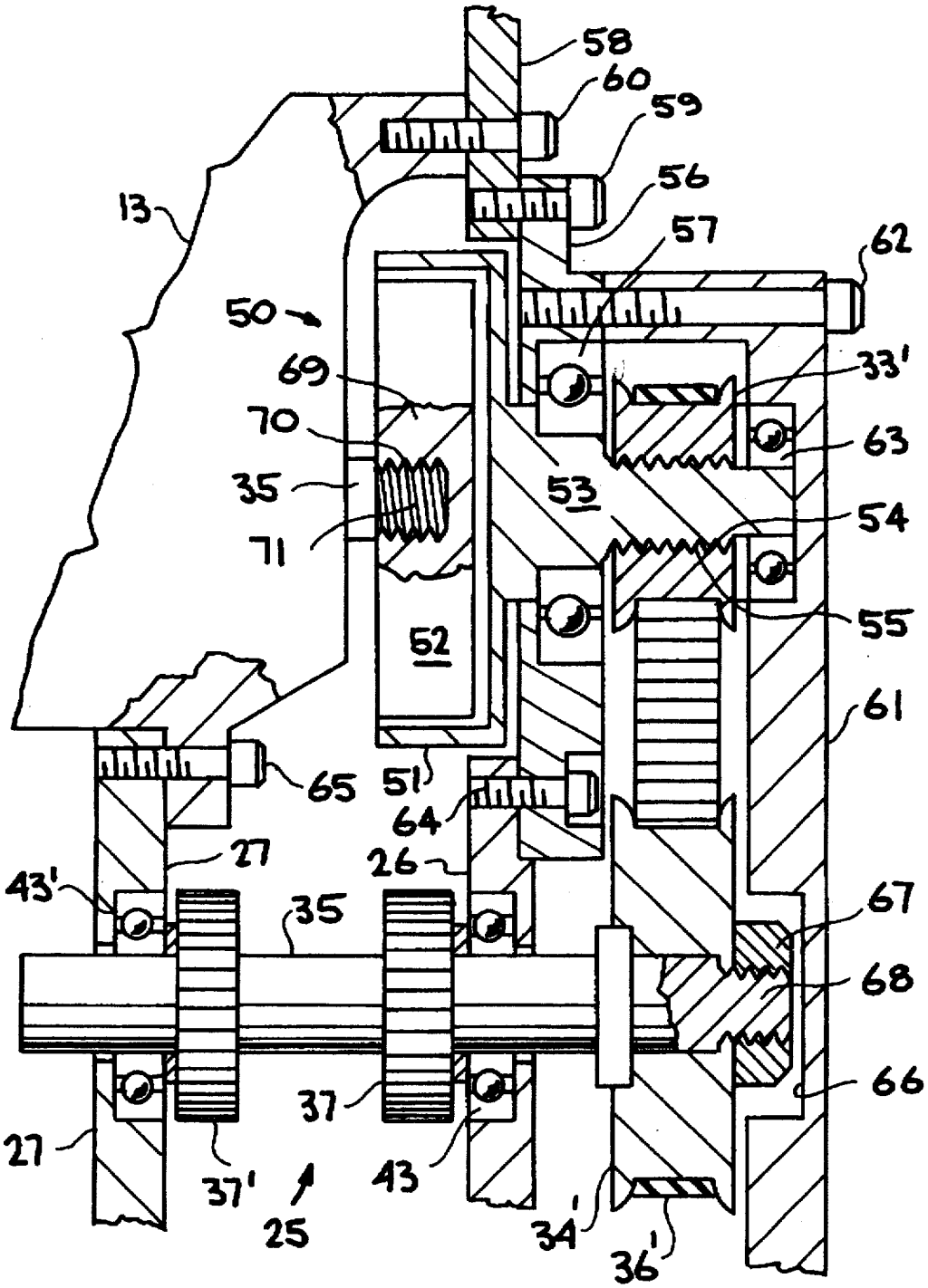
FIG. 6 illustrates an embodiment of a centrifugal clutch arrangement for the reduction gear train of FIG. 4.

FIGS. 6 and 7 illustrate an embodiment of a centrifugal clutch incorporated into the reduction gear train 25 of FIG. 4. As shown, a, centrifugal clutch assembly generally indicated at 50, which is a standard off-the-shelf clutch, is mounted on engine shaft 31 and includes a clutch housing 51 and a clutch pad/spring assembly 52, shown in detail in FIG. 7, which is mounted within housing 51. Clutch housing 51 has a reduced diameter section 53 having external threads 54 thereon which cooperate with internal threads 55 of a first pulley 33' which drives a second pulley 34' via a toothed drive belt 36', as in the FIG. 5 embodiment, which drives the first reduction gears 37–37'. The reduced diameter section 53 of clutch housing 51 is mounted in a support plate 56 via a bearing assembly 57 which is secured to a plate 58 via at least one threaded bolt 59, with plate 58 being mounted on engine 13 via at least one threaded bolt 60. A cover plate 61 is secured to support plate 56 via at least one threaded bolt 62 and within which is mounted a bearing assembly 63 for the end of section 53 of clutch housing 51. Support plate 56 is connected via at least one threaded bolt 64 to support plate 26, with support plate 27 being mounted to engine 13 via at least one threaded bolt 65. The cover plate 61 additionally includes a cut-away section 66 in which shaft 35 is secured to pulley 34' by a self-locking nut 67 secured to a threaded end 68 of shaft 35.

As seen in FIG. 7, the centrifugal clutch pad/spring assembly 52 comprises a clutch plate 67 having a threaded opening 70 into which a. threaded end 71 of engine shaft 35 is mounted, as seen in FIG. 6. A pair of clutch pads 72 are mounted in clutch plate 69 and interconnected by springs 73. Since the centrifugal clutch assembly 50 is a standard well known clutch, further detailed description or operation thereof is deemed unnecessary to enable an understanding thereof.

While not shown, the reduction gear train between the engine drive shaft and the powered in-line skate wheel may be provided with a brake arrangement, other than the rubber pad arrangement, such as a cable/lever controlled pressure member on the powered wheel or the second pulley, with the brake cable/lever being incorporated into the hand-held control unit.

It has thus been shown that the present invention involves an engine powered in-line skate with a hand-held speed (throttle) control unit, which provides a user with an inexpensive alternate transportation mode for work or pleasure. The powered in-line skate utilizes a reduction gear train designed to safely enable speeds of about 20 MPH with little consumption of our natural resources and little pollution of the environment. While the engine has only been illustrated and described for one of a pair of in-line skates, an engine or engine/clutch arrangement can be mounted on each of a pair of in-line skates. The use of two powered in-line skates may be desirable for activities such as racing or for large users to increase the operational speed, etc. Also, a centrifugal clutch may be incorporated into the reduction gear train.

While a particular embodiment of the powered in-line skates and embodiments of the gear train, along with particular parameters, materials, etc. are set forth to exemplify the teach the principles of the invention, such are not intended to be limiting. Modifications and changes may become apparent to those skilled in the art, and it is intended that the invention be limited only by the scope of the appended claims.

What is claimed is:

1. In a pair of in-line skates, each skate having a frame with two laterally spaced frame members and a single row of wheels rotatably mounted between the two frame members, the improvement comprising:

power drive means mounted to the frame of at least one of said pair of in-line skates;

a hand-held control unit connected to said drive means for controlling said drive means; and a reduction gear train operatively connected between said drive means and a rearmost wheel of said skate, said reduction gear train including two pairs of gears with each pair of gears being positioned alongside a respective frame member, each pair of gears having a first gear and a second gear with the first and second gears being drivingly interconnected, the first gear of each pair of gears being interconnected for simultaneous rotation and the second gear of each pair of gears being interconnected for simultaneous rotation, and each pair of gears being rotatably mounted to a respective frame member and drivingly connected to said rearmost wheel.

2. The improvement of claim 1, wherein said power drive means includes an internal combustion engine, said hand-held control unit including a cable operatively connected to control operating speed of said engine.

3. The improvement of claim 2, wherein said hand-held control unit includes a lever operatively connected to said cable, whereby movement of said lever causes a change in speed of said engine.

4. The improvement of claim 2, additionally including means adapted to retain said cable to an associated user.

5. The improvement of claim 2, additionally including footwear secured to said frame, said engine being mounted to said frame behind said footwear.

6. The improvement of claim 5, additionally including a clutch arrangement operatively connected to said reduction gear train and said engine.

7. The improvement of claim 2, wherein said reduction gear train additionally includes a pulley/belt assembly, said pulley/belt assembly being operatively connected to a drive shaft of said engine and to one pair of said gears.

8. The improvement of claim 1, wherein said reduction gear train additionally includes a belt driven assembly operatively connected to one pair of said gears.

9. The improvement of claim 1, wherein said reduction gear train additionally includes a clutch assembly.

10. The improvement of claim 1, wherein said power drive means includes a motor, and wherein said reduction gear train operatively interconnects a drive shaft of said motor with one of said pairs of gears.

11. The improvement of claim 10, wherein said reduction gear train additionally includes a pulley/belt assembly operatively interconnecting said motor drive shaft with one of said pairs of gears.

12. The improvement of claim 10, wherein said reduction gear train includes a centrifugal clutch arrangement.

13. The improvement of claim 10, wherein said hand-held control unit includes a movable lever, and a cable interconnecting said motor and said movable lever, whereby movement of said lever causes a change in speed of said motor.

14. The improvement of claim 13, wherein said motor comprises an internal combustion engine.

15. The improvement of claim 1, wherein said reduction gear train includes an additional pair of gears operatively connected to one pair of said two pair of gears, whereby the reduction gear train comprises three pairs of gears intermediate said powered drive means and said rearmost wheel of said skate.

16. In an in-line skate having a frame with two laterally spaced frame members and a single row of wheels rotatably mounted between the two frame members, the improvement comprising:

a second frame adapted to be secured to said frame of said skate, said second frame having a pair of spaced side members, a motor mounted on said second frame;

a hand-held control unit connected to said motor for controlling said motor; and a reduction gear train adapted to be connected between said motor and rearmost wheel of said skate, said reduction gear train including two pairs of gears with each pair of gears positioned alongside a respective side member of said second frame, each pair of gears having a first gear and a second gear with the first and second gears being drivingly interconnected, the first gear of each pair of gears being interconnected for simultaneous rotation and the second gear of each pair of gears being interconnected for simultaneous rotation, and each pair of gears being rotatably mounted to a respective side member of said second frame and adapted to be drivingly connected to said rearmost wheel.

17. The improvement of claim 16, additionally including a clutch assembly mounted intermediate said reduction gear train and said motor.

18. In an in-line skate having a frame with two laterally spaced frame members and a single row of wheels rotatably mounted between the two frame members, the improvement comprising:

a second frame adapted to be secured to said frame of said skate, said second frame having a pair of spaced side members;

a motor mounted on said second frame;

a hand-held control unit connected to said motor for controlling said motor;

a reduction gear train operatively connected between said motor and a rearmost wheel of said skate, said reduction gear train including two sets of gears with each set of gears being positioned alongside a respective side member of said second frame, each set of gears including at least two gears which are drivingly interconnected, a first gear of each set of gears having a different diameter than a second gear of each set of gears, the first gear of each set of gears being interconnected for simultaneous rotation and the second gear of each set of gears being interconnected for simultaneous rotation, and each set of gears being rotatably mounted to a respective side member of said second frame and drivingly connected to said rearmost wheel; and a clutch assembly operatively connected between said motor and said reduction gear train.

* * * * *